United States Patent [19]

Shindo et al.

[11] 4,121,411

[45] * Oct. 24, 1978

[54] FALSE TWISTING SPINDLE

[75] Inventors: Noboru Shindo, Maikatashi; Hiroshi Hashizume, Kyotoshi; Shuichi Kikuchi, Nagaokakyoshi, all of Japan

[73] Assignee: Murata Kikai Kabushiki Kaisha, Japan

[ * ] Notice: The portion of the term of this patent subsequent to Aug. 31, 1993, has been disclaimed.

[21] Appl. No.: 718,919

[22] Filed: Aug. 30, 1976

Related U.S. Application Data

[63] Continuation of Ser. No. 493,508, Aug. 1, 1974, Pat. No. 3,977,171.

[30] Foreign Application Priority Data

Aug. 8, 1973 [JP] Japan ..... 48-89573

[51] Int. Cl.[2] ..... D02G 1/04

[52] U.S. Cl. ..... 57/77.3; 57/77.45

[58] Field of Search ..... 57/77.3–77.45

[56] References Cited

U.S. PATENT DOCUMENTS

| | | | |
|---|---|---|---|
| 2,777,276 | 1/1957 | Klein | 57/77.3 |
| 2,942,405 | 6/1960 | Ward et al. | 57/77.45 |
| 2,990,674 | 7/1961 | Stoll et al. | 57/77.33 |
| 3,392,519 | 7/1968 | Parker | 57/77.45 |
| 3,759,025 | 9/1973 | Takai et al. | 57/77.45 X |

*Primary Examiner*—Donald Watkins

*Attorney, Agent, or Firm*—Whittemore, Hulbert & Belknap

[57] ABSTRACT

A false twisting spindle comprises a turbine including a hollow turbine shaft, a twister pin mounted in the hollow shaft and a turbine blade impeller. The turbine is mounted in a hollow hole of a housing by being supported by means of fluid bearings. The most preferable diameter of the turbine blade impeller is determined depending on the denier of a yarn employed.

1 Claim, 6 Drawing Figures

FALSE TWISTING SPINDLE

BACKGROUND OF THE INVENTION

This is a continuation of application Ser. No. 493,508, filed Aug. 1, 1974, now U.S. Pat. No. 3,977,171.

The present invention relates to a false twisting spindle including a burbine blade impeller which is rotated by a fluid.

Various attempts have recently been made to improve the yarn production rate by increasing the rotation number of a false twisting spindle in a false twisting machine. However, this is a very difficult problem, because it is desired that the rotation number is maintained stably to obtain false-twisted yarns having good quality while it is necessary to increase the rotation number.

It is therefore a primary object of this invention to provide a false twisting spindle which is supported by fluid bearings and can be rotated stably against increase of the rotation number by a fluid provided separately from the bearing fluid and load variations brought about characteristically in false twisting spindles, and which provided economical advantages when it is applied to the actual operation.

DETAILED DESCRIPTION OF THE INVENTION

Figure 1:
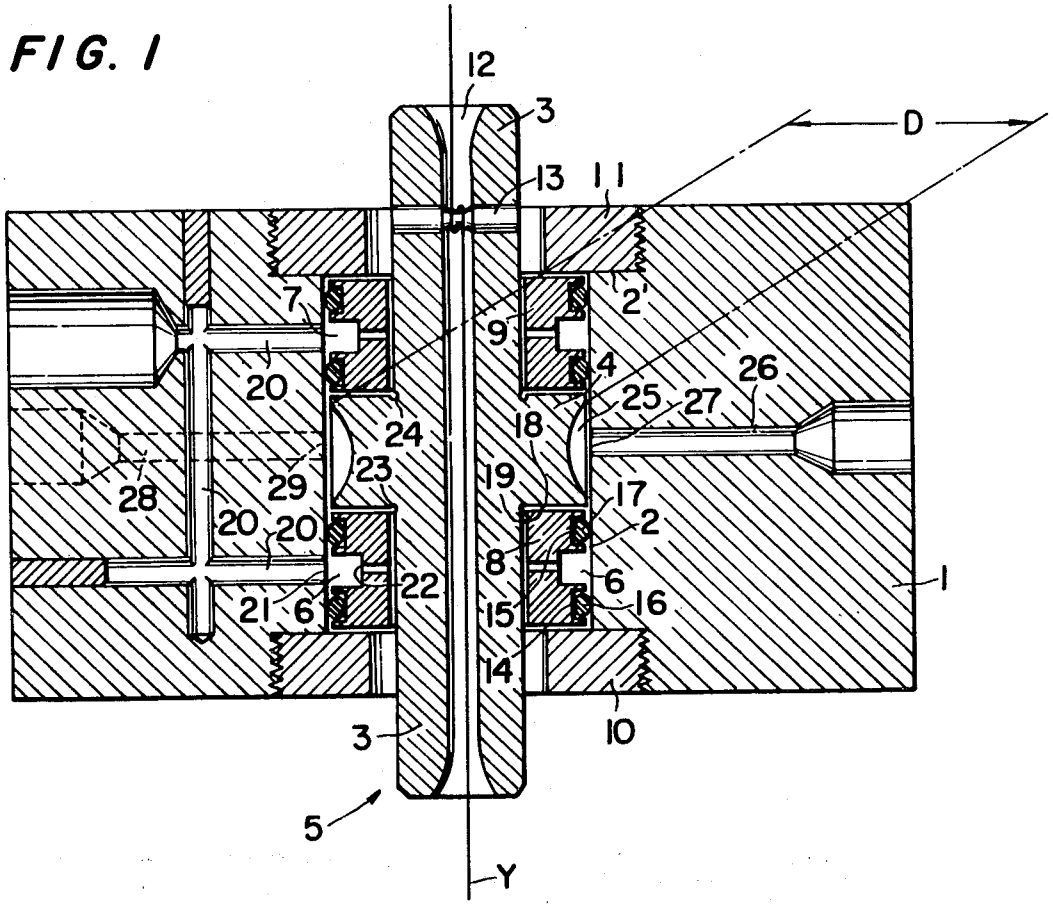
FIG. 1 is a longitudinal sectional front view of one embodiment of the false twisting spindle of the present invention.

Referring first to FIG. 1, there is shown one embodiment of the false twisting spindle of the present invention. A turbine 5 including a turbine shaft 3 and a turbine blade impeller 4 is mounted into a hollow hole 2 perforated through a housing 1. The turbine 5 is fixed by nuts 10 and 11 with columnar bearings 8 and 9 having a groove 6 or 7 being disposed on the upper and lower faces of the turbine blade impeller, respectively, to hold the turbine impeller therebetween. A twister pin 13 is mounted in a hollow hole 12 of the turbine 5, and yarn Y travels while it is wound once on the twister pin 13. A step 2' of the hollow hole 2 need not always be provided, and the fixing of the turbine may also be accomplished by using one of nuts 10 and 11 while the other portion is merely fixed or formed into a step.

Grooves 14 and 15 are formed on the bearing 8, and o-rings 16 and 17 are disposed in the grooves, whereby a damping force is outwardly given to swirling rotation of the turbine shaft 3 and the bearing face 19 confronting the end face 18 of the turbine blade impeller, namely the propelling force pressure-receiving force, can follow the end face of the turbine blade impeller. An inlet opening 21 of a fluid passage 20 in the housing 1 confronts the groove 6 of the bearing, and a fluid outlet 22 is opened to flow out the fluid from the groove 6. The fluid coming from the fluid outlet 22 is introduced into a clearance formed between the turbine shaft 3 and the bearing 8, resulting in generation of a bearing-loading capacity. Recesses 23 and 24 formed on the contact line of the turbine blade impeller 4 and the turbine shaft 3 are contributive to discharge of the fluid and have an activity of increasing the bearing-loading capacity. The fluid is guided by said recesses 23 and 24 and turns its direction. Thus, the fluid is flown between the end face 18 of the turbine blade impeller and the end face 19 of the bearing, namely the propelling force-receiving faces. A flow-out hole 27 of a rotation fluid passage 26 and a inlet hole 29 of a discharge fluid passage 28 are opened on the housing at the position confronting the blade 25 of the turbine blade impeller 4.

When a false twisting spindle having the above structure is employed, a desired high rotation number can be obtained stably. However, if such false twisting spindle is used for the actual yarn production, it is still insufficient. More specifically, when in a false twister it is possible to increase the rotation number, if fluid is used in disregard of economy, the false twister cannot be regarded as a practical false twister. Therefore, we furthered our research works on the false twisting spindle having the above structure.

Figure 2:
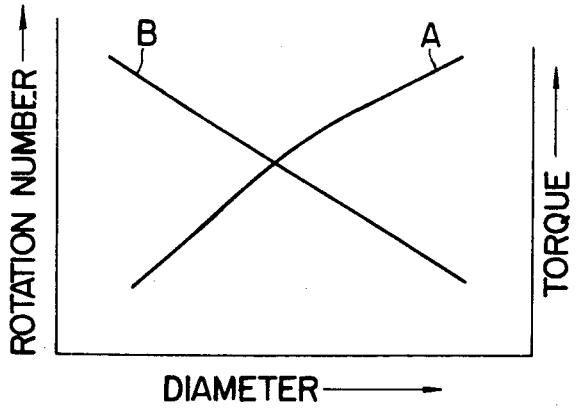
FIGS. 2 to 5 are graphs showing influences of the change in the turbine blade impeller diameter on the rotation number thereof, torque of yarns and fluid flow amount.
Figure 3:
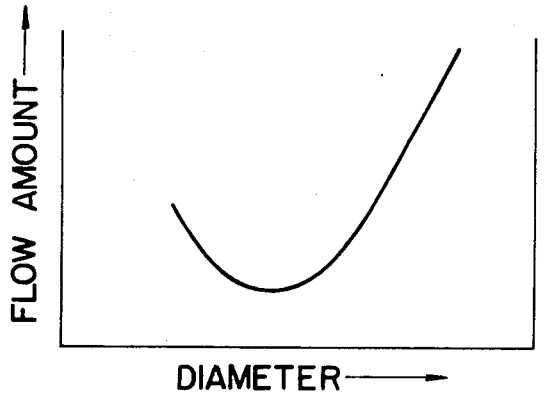
Figure 6:
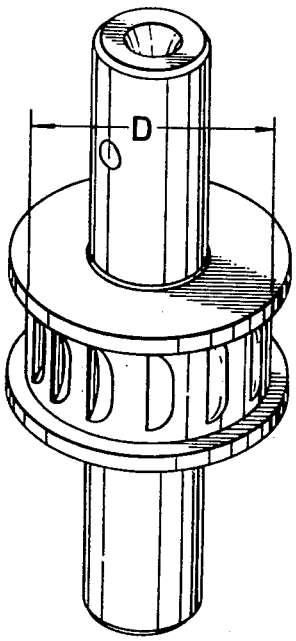
FIG. 6 is a perspective view showing another embodiment of the turbine.

As a result, it was first found that when the spindle is driven by using turbine blade impellers differing in the diameter (D) (see FIG. 1; when a flanged turbine is employed, the diameter (D) is shown in FIG. 6) under a prescribed air flow amount condition, with increase of the diameter the torque of the yarn increases but the rotation number of the turbine decreases, and with decrease of the diameter the rotation number (B) increases but the torque (A) decreases, as shown in FIG. 2. From this finding, it was confirmed that there is present an optimum diameter for keeping a prescribed rotation number under a certain load condition, and that when the diameter is larger than this optimum diameter, it is necessary to increase the flow amount of fluid to cover the decrease of the rotation number and when a turbine having a diameter smaller than the optimum diameter, it is necessary to increase the flow amount of fluid to cover the reduction of the rotation number owing to the decrease of the torque. This fact is shown in the graph of FIG. 3, as a curve under a certain load condition and a prescribed rotation number. Thus, we arrived at the knowledge that if the turbine blade impeller diameter is selected appropriately, the operation can be performed effectively. Change in the diameter was performed by exchanging only a turbine with another turbine differing in the turbine blade impeller diameter by taking off nuts or by selecting a suitable false twisting spindle among spindles differing in the diameter which had been preliminarily reserved.

Figure 4:
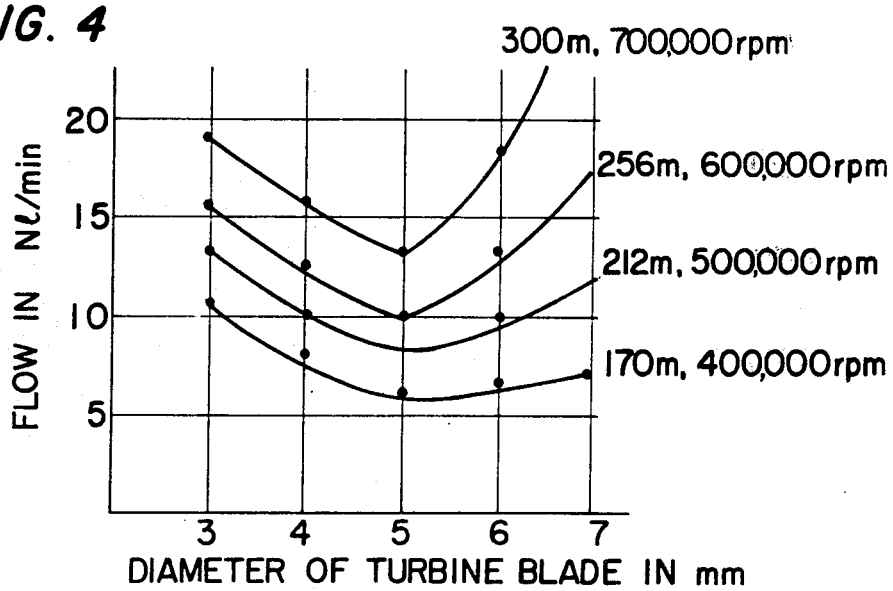

A 150-denier thermoplastic filamentary yarn was processed to impart to the yarn a twist number of 2350 turns per meter by employing the twisting spindle under the following conditions: a yarn running speed of 170 m and a spindle rotation number of 400,000 rpm, a yarn running speed of 212 m and a spindle rotation number of 500,000 rpm, a yarn running speed of 256 m and a spindle rotation number of 600,000 rpm or a yarn running speed of 300 m and a spindle rotation number of 700,000 rpm. Results are shown in FIG. 4. When the relation between the diameter of the turbine blade impeller and the fluid flow amount was examined, it was found that in each case the fluid flow amount was the smallest when the turbine blade impeller had a diameter of about 5 mm. From the results shown in the graph of FIG. 4, it is seen that under the same load (same denier yarn and twist number) a minimum flow amount, namely a most economical turbine blade impeller diameter, is almost the same regardless of the rotation number. From the above relation between the fluid flow amount and the turbine blade impeller, it is seen that in a practical false twister it is desired that the turbine blade impeller diameter is 5 mm when a yarn to be processed has a 150-denier fineness.

Figure 5:
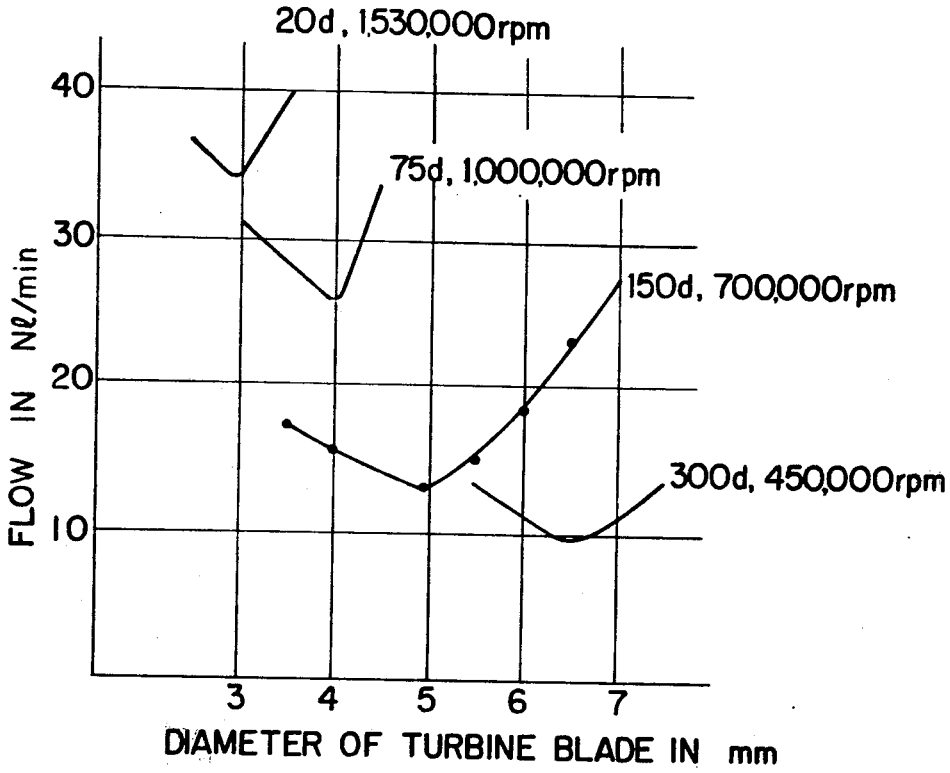

In view of the foregoing experimental results, we made further experiments using turbine blade impellers having a diameter of 2.5, 3, 3.5, 4, 4.5, 5, 5.5, 6, 6.5 or 7 mm in order to find out optimum diameters as regards respective deniers. Results are shown in FIG. 5, from which it is seen that optimum results are obtained when the turbine blade impeller diameter is 3 mm in the case of a 20-denier yarn, 4 mm in the case of a 75-denier yarn, 5 mm in the case of a 150-denier yarn or 6.5 mm in the case of a 300-denier yarn. From the foregoing experimental results, it was thus found that use of a turbine blade impeller having an optimum diameter selected depending on the deniers of yarn is very effective and practical.

Experiments were conducted by changing the number of blades within a range of 2 to 14 and the blade width within a range of 0.5 mm to 10 mm, and it was found that the characteristics shown in FIG. 5 are not changed even if the flow amount is changed to some extent at the same rotation number by the above change of the blade number and blade of width.

What is claimed is:

1. A false twisting spindle comprising a turbine having a hollow cylindrical shaft at the axis of rotation thereof and a turbine blade impeller on the outer periphery centrally thereof, the diameter of the turbine blade impeller having a determined relation to the denier of a yarn to be twisted by the spindle, a twister pin extending transversely of the turbine shaft across the opening therein adjacent one end thereof, and mounting means for the turbine including a body member and bearings therefor rotatably mounting the turbine in the body member.

* * * * *